United States Patent [19]

Ziegler

[11] Patent Number: 4,874,341

[45] Date of Patent: Oct. 17, 1989

[54] FOLDING POLYGONAL TOY CONSTRUCTION ELEMENT

[75] Inventor: James T. Ziegler, Toronto, Canada

[73] Assignee: Novation Design Ltd., Ontario, Canada

[21] Appl. No.: 261,924

[22] Filed: Oct. 25, 1988

[51] Int. Cl.[4] ..... A63H 33/08; A63H 33/12; A63H 33/00

[52] U.S. Cl. ..... 446/109; 446/104; 446/125; 446/487

[58] Field of Search ..... 446/104, 102, 106, 109, 446/112, 115, 116, 122, 124, 125, 486, 487, 488

[56] References Cited

U.S. PATENT DOCUMENTS

| | | | |
|---|---|---|---|
| 2,791,868 | 5/1957 | Viken | 446/116 X |
| 3,271,895 | 9/1966 | Sorensen | 446/104 |
| 3,597,858 | 8/1971 | Ogsbury | 446/115 X |
| 3,654,375 | 4/1972 | Geiger | 446/488 X |
| 3,777,393 | 12/1973 | Baer . | |
| 3,811,682 | 5/1974 | Neale et al. . | |
| 3,940,142 | 2/1976 | Hinz et al. | 446/109 X |
| 4,209,934 | 7/1980 | Ogawa | 446/122 X |
| 4,509,930 | 4/1985 | Schweigert et al. | 446/109 |
| 4,685,892 | 8/1987 | Gould et al. | 446/109 |
| 4,731,041 | 3/1988 | Ziegler | 446/117 X |

FOREIGN PATENT DOCUMENTS

| | | | |
|---|---|---|---|
| 2054438 | 11/1970 | Fed. Rep. of Germany | 446/124 |
| 2251951 | 10/1972 | Fed. Rep. of Germany | 446/124 |
| 0121433 | 10/1984 | PCT Int'l Appl. | 446/116 |

*Primary Examiner*—Robert A. Hafer
*Assistant Examiner*—D. Neal Muir
*Attorney, Agent, or Firm*—Wegner & Bretschneider

[57] ABSTRACT

A polygonal toy construction element is described having a substantially flat body portion with edge faces and top and bottom faces. Each edge face has a plurality of outwardly projecting integrally formed connectors adapted to connect with corresponding projecting connectors of an edge face of another construction element in a snap-together lateral interlock between adjacent elements while permitting hinging action between connected element on an axis parallel to connected edge faces. According to the novel feature of the invention, the polygonal construction element has at least one line of reduced thickness extending across the element between at least two apices of the polygon to form a living hinge which separates the element into at least two face portions joined by a living hinge and at least one edge face. This has the advantage of making possible a greatly increased variety of constructions while using only one modular edge length.

6 Claims, 3 Drawing Sheets

FOLDING POLYGONAL TOY CONSTRUCTION ELEMENT

This invention relates to building toys and, more particularly, to polygonal construction elements capable of being connected together by their edges.

Various types of constructions toys and sets have been known and one example is shown in Zimmerman, U.S. Pat. No. 2,776,521 which discloses an edge connector system generally similar to this invention. The object of the Zimmerman design is to provide a construction toy in which the basic units are flat, simple geometric figures, such as squares or equilateral triangles which are adapted to be joined to each other to form three-dimensional figures. In particular, it relates to a construction toy in which the basic units are provided with identical edges adapted to mesh to form a hinge and allow a large number of configurations to be assembled, including many regular three-dimensional geometric shapes.

A newer form of construction set with modular elements is described in Ziegler, U.S. Pat. No. 4,731,041 granted Mar. 15, 1988. This design utilizes a combination of hinging edge connectors and facially projecting connector hubs which allows the connecting together of the modular elements in many unique combinations.

Another toy construction concept is described in Lemkin, et al U.S. Pat. No. 3,670,449 issued June 20, 1972. Among other things, it describes the construction of a small box like structure by means of flat construction elements joined at edges thereof by living hinges.

It is an object of the present invention to provide polygonal construction elements capable of being assembled into an even wider variety of structural shapes than was possible with the previous systems.

SUMMARY OF THE INVENTION

According to the present invention there is provided a polygonal toy construction element comprising a substantially flat body portion having edge faces and top and bottom faces. Each edge face has a plurality of outwardly projecting integrally formed connectors adapted to connect with corresponding projecting connectors of an edge face of another construction element in a snap-together lateral interlock between adjacent elements while permitting hinging action between connected elements on an axis parallel to the connected edge faces. The novel construction element of this invention is characterized by having at least one line of reduced thickness extending across the element between at least two apices of the polygon to form a living hinge which separates the element into at least two face portions joined by said living hinge and at least one said edge face.

According to a preferred embodiment the edge connectors comprise a plurality of outwardly projecting integrally formed fingers and spaces therebetween. The fingers and spaced are positioned along each side edge of an element such that the alignment of fingers and spaces along the edge face of an element will inversely mate with corresponding fingers and spaces of an edge face of another element. A side edge of at least one of the fingers has a convex projection and at least one of the fingers has a depression such that the projections and depressions are arranged to provide a snap-together lateral interlock between adjacent elements while permitting hinging action between elements on an axis parallel to an edge face.

The construction element of this invention can assume many different polygonal shapes having four or more sides. For instance, they may be squares, pentagons, hexagons, octagons, etc. Each edge of each polygon is preferably of the same length such that all edge faces are interconnectable. They may be formed from a wide variety of plastic materials having the resilience necessary to withstand multiple foldings along a thin strip.

One of the key benefits of the construction element of this invention is that the living hinge provides for additional movement and shapes without the necessity of introducing irregular edge lengths. For instance, a square element with a living hinge according to the present invention may become two right triangles. If a separate right triangle were manufactured, it would have two equal edge lengths and one unequal edge length. The living hinge extending between apices of a polygon makes it possible to greatly increase the variety of constructions while using only one modular edge length.

The invention is further illustrated with reference to the attached drawings which, by way of non-restrictive examples, illustrates a variety of construction elements and some structures according to the invention.

Figure 1:
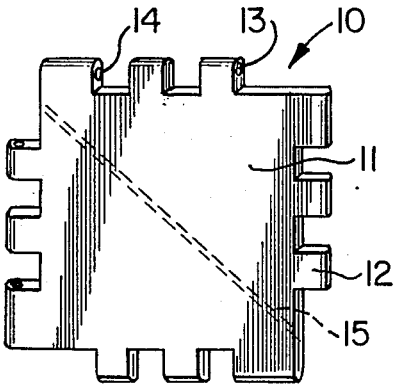
FIG. 1 is a top perspective view of one of the basic elements of the invention.
Figure 2:
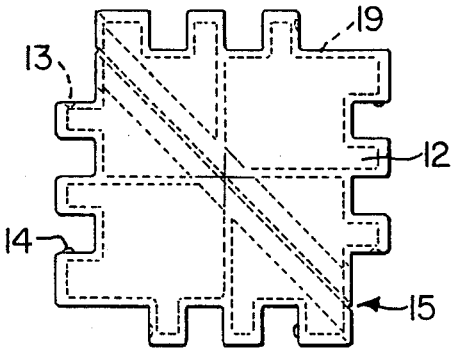
FIG. 2 is a top plan view of the element of FIG. 1.
Figure 3:
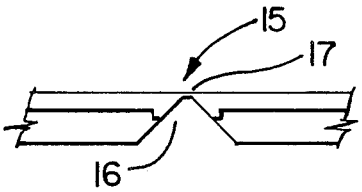
FIG. 3 is a partial edge view showing a living hinge section.
Figure 4:
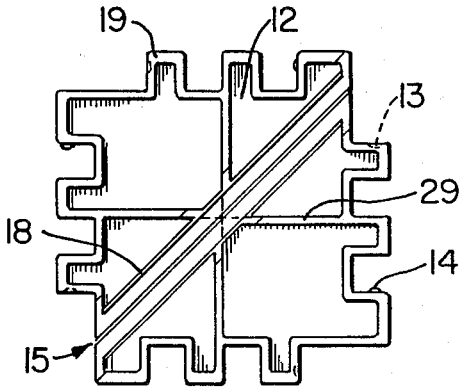
FIG. 4 is a bottom plan view of the element of FIG. 1.
Figure 5:
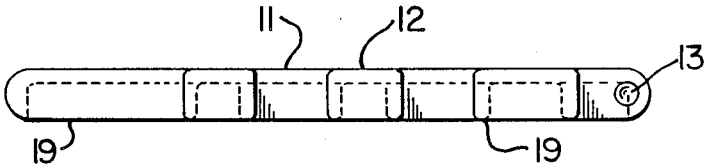
FIG. 5 is a side elevation of the element as shown in FIG. 2.

Referring now in more detail to the drawings, and particularly to FIGS. 1 to 5, there is shown a basic polygonal construction element 10 of square configuration and having a general planar body portion 11. Projecting from the four lateral edges of this planar square body are a series of outwardly projecting integrally formed fingers 12 of generally square or rectangular cross section. The edge faces of the element, including the fingers 12, are formed by a downwardly extending skirt portion 19, with the edge faces of fingers 12 have mating concave depressions 13 and convex projections 14 arranged as shown. It is not essential to provide these depressions and projections in every finger.

Extending across between opposite corners of the element 10 is a living hinge 15 consisting of a groove 16 formed in the bottom face of the element 10 to create a very thin wall area 17 adjacent the top face of the element with this thin strip 17 creating the living hinge. Preferably, stiffening strips 18 are provided adjacent the groove 16, and additional stiffeners 29 may extend across the element.

Figure 6:
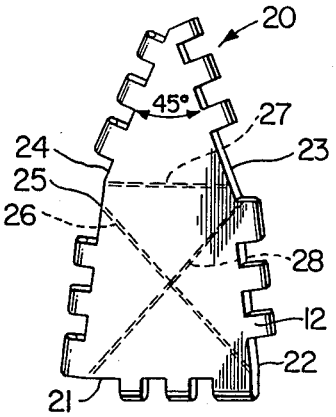
FIG. 6 is a perspective view of an irregular six sided polygonal element.

FIG. 6 shows an irregular shaped pentagon 20 having two faces 23, 24 forming a 45° angle therebetween and three further faces 21, 22 and 25. A living hinge 27 divides a triangular portion from the remainder of the pentagon and that remainder of the pentagon is further divided by two living hinges 26 and 28.

Figure 7:
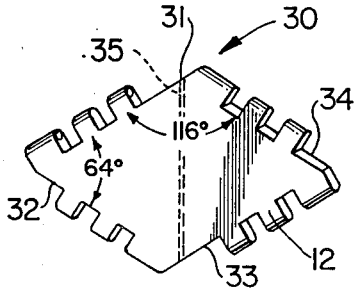
FIG. 7 is a perspective view of a diamond shaped element.

FIG. 7 shows a diamond shaped element 30 and it will be appreciated that the angles of this diamond shaped element may be varied. It includes four edge faces 31, 32, 33 and 34 with the usual projecting fingers 12 and a single living hinges 35 and 36 extending across between opposite corners of the element. These living hinges 35 and 36 divides the diamond shaped structure into equal triangles.

Figure 8:
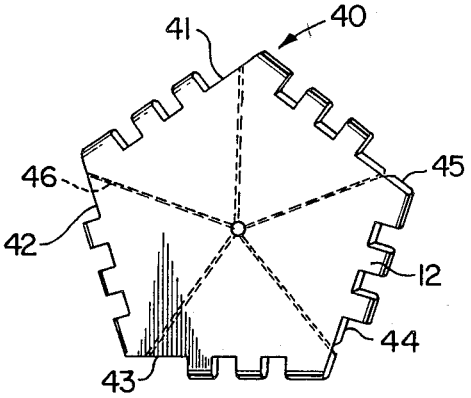
FIG. 8 is a perspective view of an element in the form of a pentagon.

A regular pentagon 40 is shown in FIG. 8 having five equal sides 41, 42, 43, 44 and 45 with projection fingers 12. This element is divided into five identical triangular sections by means of five living hinges 46 extending between corners of the pentagon and the center of the pentagon.

Figure 9:
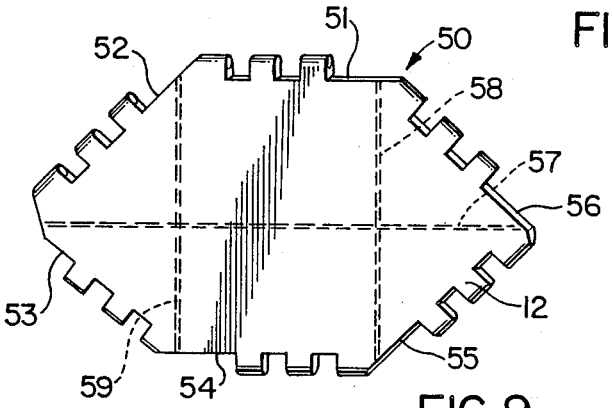
FIG. 9 is a perspective view of a further six sided polygonal element.

A form of hexagon 50 is shown in FIG. 9 with six equal side edges 51, 52, 53, 54, 55 and 56, with the usual projecting fingers 12. This element is divided into two triangles and a rectangle by means of living hinges 58 and 59 and is also divided into a pair of four sided figures by means of living hinge 57.

In some situations, it may be desirable to provide a hole through the element at the point where several living hinges converge. One such hole is shown at the center of the pentagon in FIG. 8 and a similar hole may, for instance, be used at the center of the element of FIG. 7, etc. This hole at the point of convergence of the living hinges simplifies the multiple folds that occur at that point.

Figure 10:
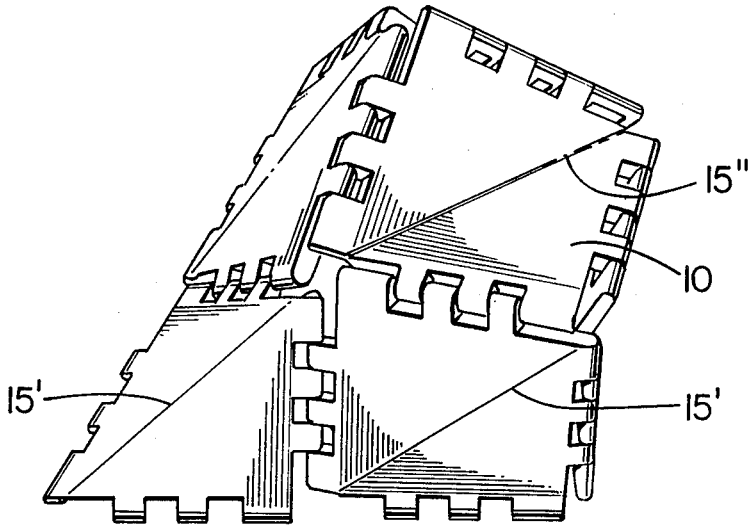
FIG. 10 is a perspective view of one structure utilizing the elements of this invention.

Each living hinge can fold in either a forward or backward direction, creating great versatility in construction design. One simple design taking advantage of both folding aspects of the living hinge is illustrated in FIG. 10. This structure has been built from folding squares according to this invention with outside living hinge fold corners 15' and inside living hinge fold corners 15''.

Figure 11:
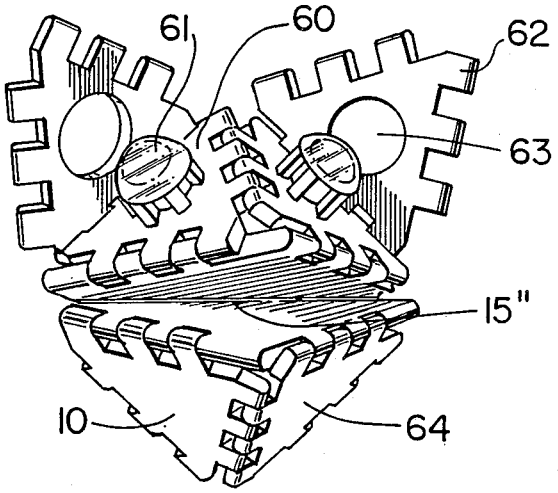
FIG. 11 is a further perspective view of a further construction using the elements of this invention.

A small animal like character constructed with the living hinge of this invention is shown in FIG. 11. This includes a folding rectangular element 10 according to this invention, having triangular pieces as described in U.S. Pat. No. 4,731,041 connected thereto with eye pieces 61. Further triangular pieces 62 with holes 63 are edge connected to the triangular pieces 60. The remainder of the character is formed by two further triangular pieces 64 connected to the folding element 10, with folding element 10 forming the mouth of the character.

Although particular embodiments of the invention have been described and illustrated herein, it is recognized the modifications and variations may readily occur to those skilled in the art and, consequently, it is intended that the claims be interpreted to cover such modifications and equivalents.

I claim:

1. A toy construction element in the form of a polygon comprising a substantially flat body portion having four or more edge faces of substantially equal length and top and bottom faces, each edge face having formed thereon a plurality of outwardly projecting integrally formed connectors adapted to connect with corresponding projecting connectors on an edge face of another construction element in a snap-together lateral interlock between adjacent elements while permitting hinging action between connected elements on an axis parallel to the connected edge faces, wherein said construction element has at least one line of reduced thickness extending across the body of the element from apices of the polygon and through the center of the body of the element to form at least one living hinge which separates the body of the element into at least two equal triangular portions joined by at least one living hinge, the three sides of each triangular portion including at least one living hinge and at least one edge face.

2. A toy construction element according to claim 1 wherein the edge connectors comprise a plurality of outwardly projecting integrally formed fingers and spaces therebetween, said fingers and spaces being positioned along each said side edge such that the alignment of fingers and spaces along the edge face of an element will inversely mate with corresponding fingers and spaces of an edge face of another element, a side edge of at least one of said fingers having a convex projection and at least one of said fingers having a depression, said projections and depressions being arranged to provide a snap-together lateral interlock between adjacent elements while permitting hinging action between elements on an axis parallel to an edge face.

3. A toy construction element according to claim 1 or 2 in the form of a square with a living hinge extending diagonally across between opposite corners.

4. A toy construction element according to claim 1 or 2 in the form of a regular pentagon with five living hinges extending between the five corners and the center of the pentagon.

5. A toy construction element according to claim 1 or 2 in the form of a hexagon.

6. A toy construction element according to claim 1 or 2 in a diamond shape foldable into equal triangles.

* * * * *